US007017236B2

(12) United States Patent
Vidal

(10) Patent No.: US 7,017,236 B2
(45) Date of Patent: Mar. 28, 2006

(54) HAND TOOL HANDLE MODIFICATION SYSTEM

(76) Inventor: Michael Vidal, 1831 N. Pass Ave., Burbank, CA (US) 91505

( * ) Notice: Subject to any disclaimer, the term of this patent is extended or adjusted under 35 U.S.C. 154(b) by 0 days.

(21) Appl. No.: 10/773,992

(22) Filed: Feb. 6, 2004

(65) Prior Publication Data

US 2004/0154134 A1 Aug. 12, 2004

Related U.S. Application Data

(63) Continuation of application No. 09/864,519, filed on May 23, 2001, now Pat. No. 6,732,411.

(51) Int. Cl.
*B25G 1/00* (2006.01)

(52) U.S. Cl. ..... 16/430; 16/442; 16/421; 81/177.6

(58) Field of Classification Search ..... 16/430, 16/426, 422, 421, 444, 113.1, 114.1, 110.1, 16/906, DIG. 25; 280/821, 822; 30/514, 30/517; D8/DIG. 5; 81/177.6, 427.5
See application file for complete search history.

(56) References Cited

U.S. PATENT DOCUMENTS 1,463,191 A * 7/1923 Batten ..... 16/426
3,217,635 A * 11/1965 Scavullo ..... 16/422
3,773,375 A 11/1973 Nehls
3,817,521 A * 6/1974 Wright ..... 473/551
4,072,311 A 2/1978 Bertucci
4,364,585 A * 12/1982 Shields ..... 280/822
4,369,546 A 1/1983 Zientara
4,644,740 A 2/1987 Lee
5,018,734 A 5/1991 Allsop
5,529,357 A 6/1996 Hoffman
5,609,175 A 3/1997 Gerry et al.
6,082,795 A 7/2000 Fornelli
6,305,051 B1 10/2001 Cho
6,732,411 B1 5/2004 Vidal

* cited by examiner

*Primary Examiner*—Robert J. Sandy
(74) *Attorney, Agent, or Firm*—Denton L. Anderson; Sheldon & Mak

(57) ABSTRACT

A hand-held instrument has a business end and a handle attached to the business end. The handle has a gripping portion and a longitudinal axis. A knob is provided on the gripping portion of the handle to facilitate the wielding of the hand-held instrument. The knob is disposed such that it projects away from the handle in a direction transverse to the longitudinal axis of the handle. In a preferred, but not required embodiment, the knob is removably attached to the handle by a quick release attachment device. In a typical, but not required, such embodiment, the quick release attachment device includes a male connection pin disposed within the knob and a female receptor disposed within the hand tool.

8 Claims, 10 Drawing Sheets

HAND TOOL HANDLE MODIFICATION SYSTEM

This is a continuation application claiming priority from U.S. patent application Ser. No. 09/864,519, now U.S. Pat. No. 6,732,411, filed May 23, 2001.

BACKGROUND OF THE INVENTION

This invention is directed to hand tools for pounding, chopping or swinging, such as hammers and hatchets. The invention addresses the problem of how to maximize control of the tool and minimize fatigue to the user of the tool.

DESCRIPTION OF THE DRAWINGS

These features, aspects and advantages of the present invention will become better understood with regard to the following description, appended claims and accompanying figures where:

DESCRIPTION OF THE INVENTION

Figure 1:
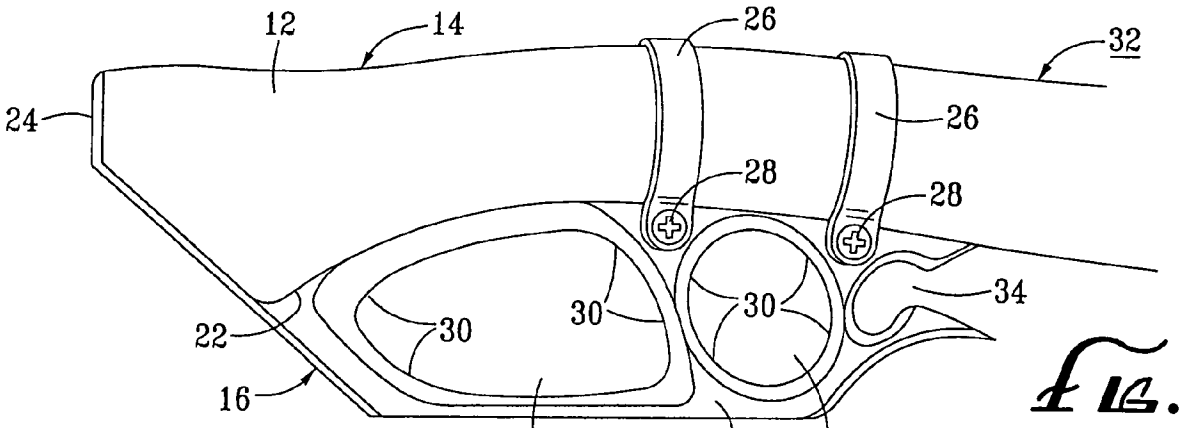
FIG. 1 is a side view of a basket having features of the invention.
Figure 2:
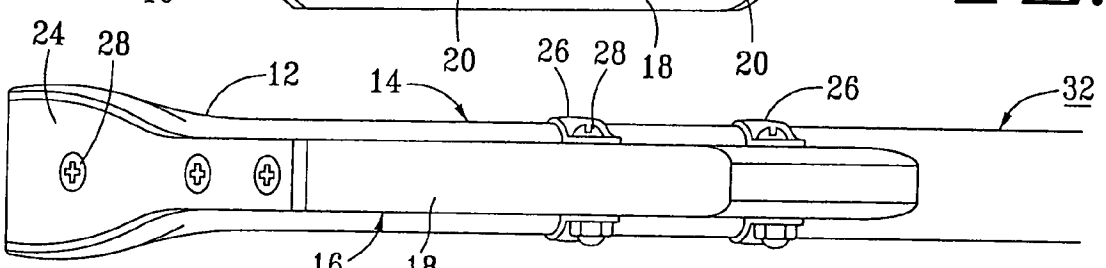
FIG. 2 is a bottom side view of the basket illustrated in FIG. 1.
Figure 3:
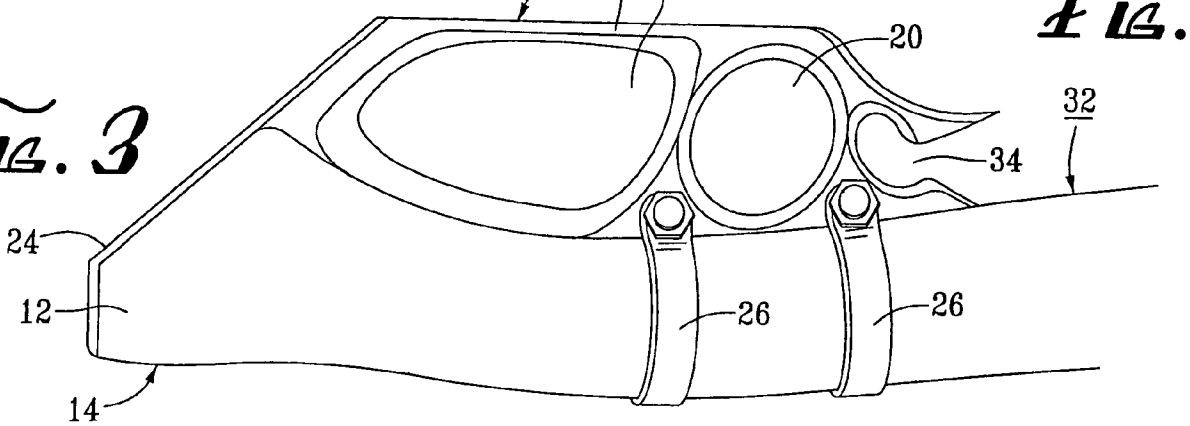
FIG. 3 is a reverse side view of the basket illustrated in FIG. 1.
Figure 4:
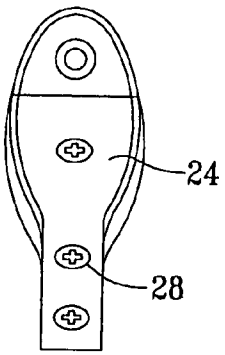
FIG. 4 is a butt end view of the basket illustrated in FIG. 1.
Figure 5:
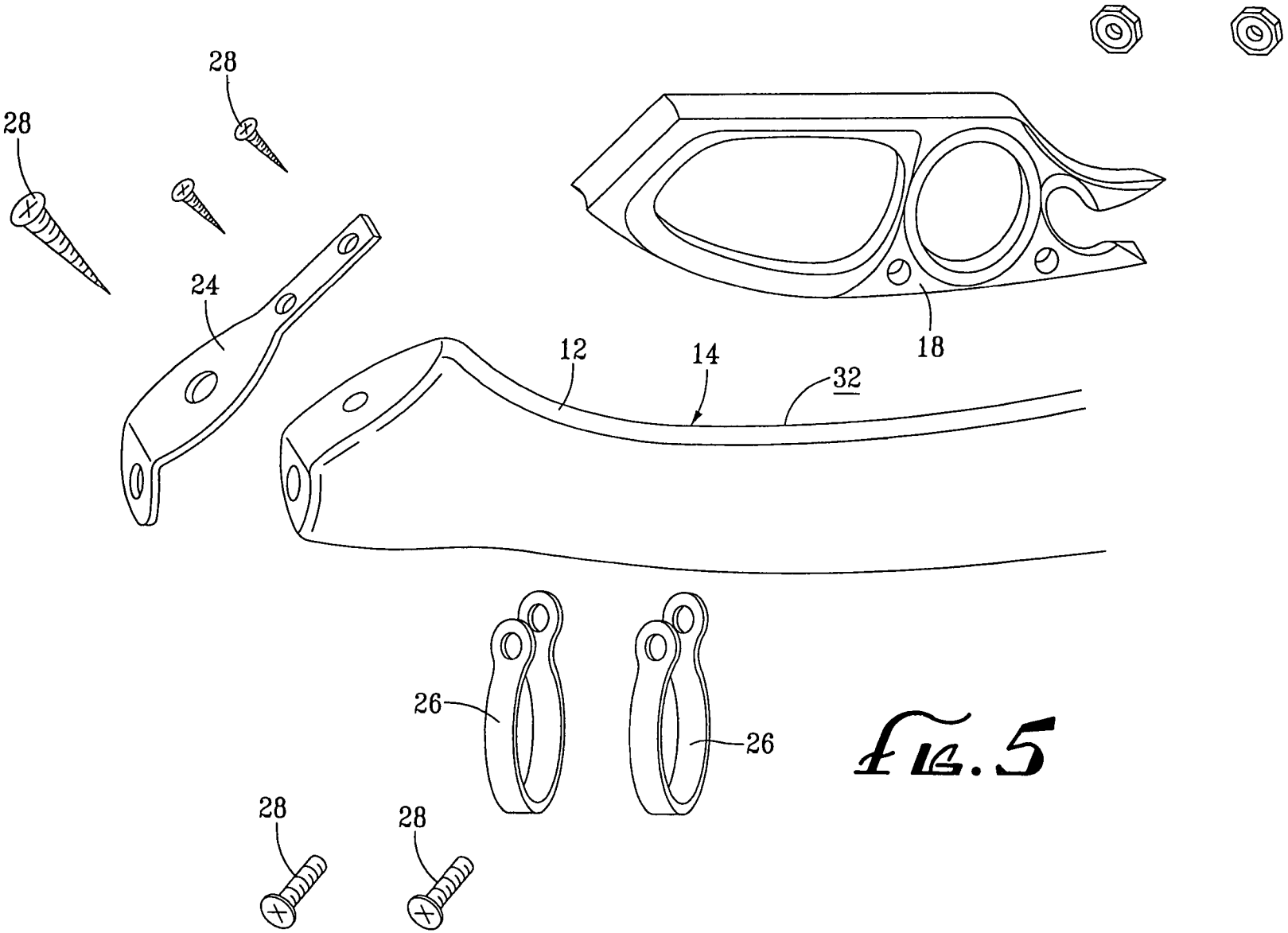
FIG. 5 is an exploded view of the basket illustrated in FIG. 1.

The following discussion describes in detail one embodiment of the invention and several variations of that embodiment. This discussion should not be construed, however, as limiting the invention to those particular embodiments. Practitioners skilled in the art will recognize numerous other embodiments as well.

In one embodiment of the invention, the base end 12 of a hand tool handle 14 is provided with a "basket" 16 as illustrated in FIGS. 1–8. The basket 16 comprises a "knuckle guard" 18 made from a metal or strong plastic. The knuckle guard 18 comprises one or more finger openings 20. In the embodiment illustrated in the drawings, the knuckle guard 18 is attached to the underside 22 of the base end 12 of the hand tool handle 14 with a rear plate 24 and a pair of clamps 26. In the embodiment illustrated in the drawings, both the rear plate 24 and the clamps 26 are secured by screws 28.

The basket 16 provides the user with additional gripping surfaces 30, making it less arduous to securely hold the handle 14 of the tool 32 during use. This makes it less likely that the user will lose control of the tool 32. It also results in markedly decreased fatigue to the hand muscles of the user, especially after prolonged use of the tool 32. The knuckle guard 18 also protects the fingers of the user from injury due to inadvertent contact of the user's fingers with hard and/or sharp surfaces existing within the work area.

Figure 6:
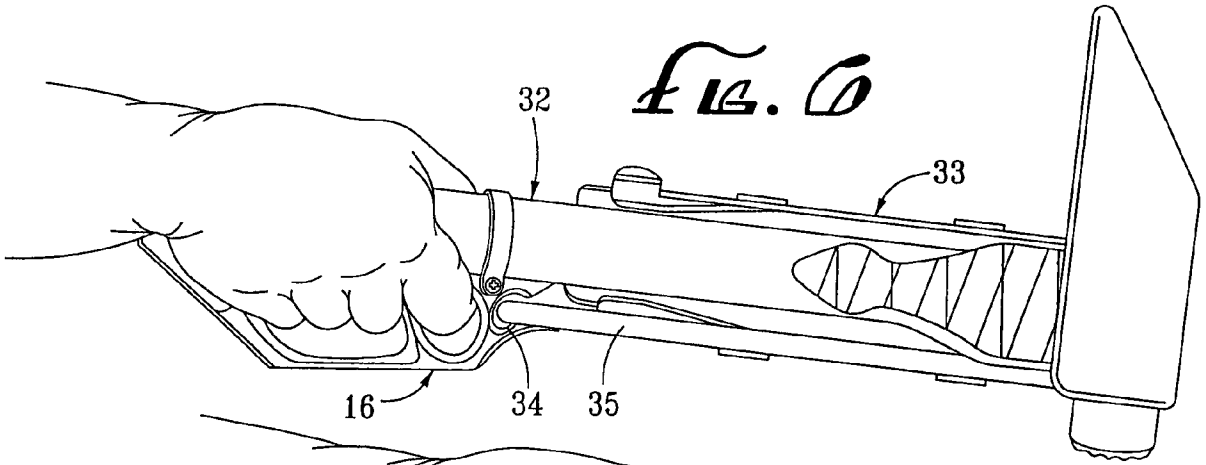
FIG. 6 is a side view of a tool carrying the basket illustrated in FIG. 1, the tool being shown engaged with a safety scabbard.
Figure 7:
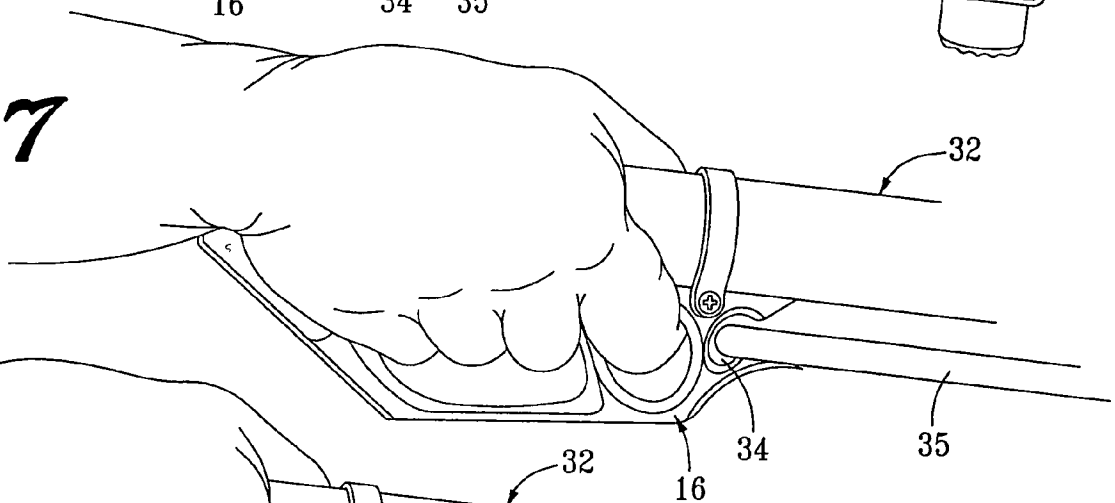
FIG. 7 is a detail view of the tool illustrated in FIG. 6.
Figure 8:
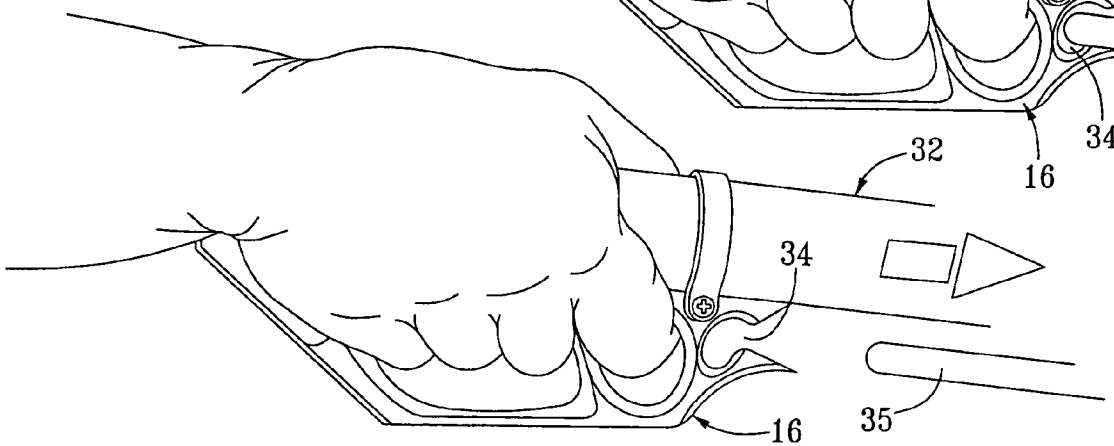
FIG. 8 is a detail view of the hand tool illustrated in FIG. 6, the tool being shown disengaged from the safety scabbard.
Figure 9:
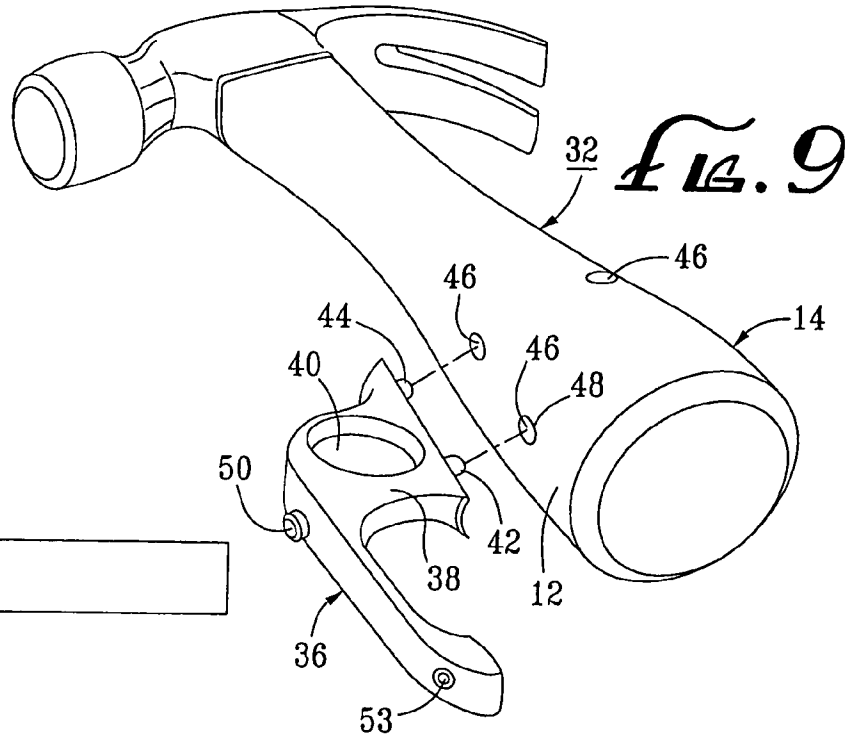
FIG. 9 is an exploded view of a grip guard having features of the invention.
Figure 11:
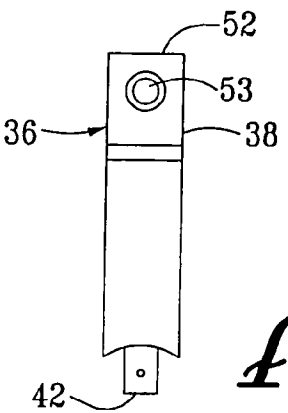
FIG. 11 is an end view of the grip guard illustrated in FIG. 9.
Figure 10:
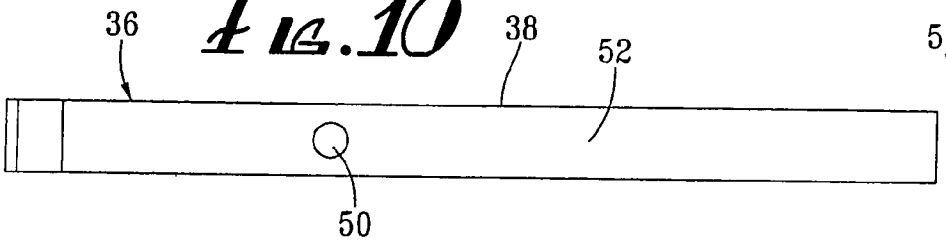
FIG. 10 is a back side view of the grip guard illustrated in FIG. 9.
Figure 12:
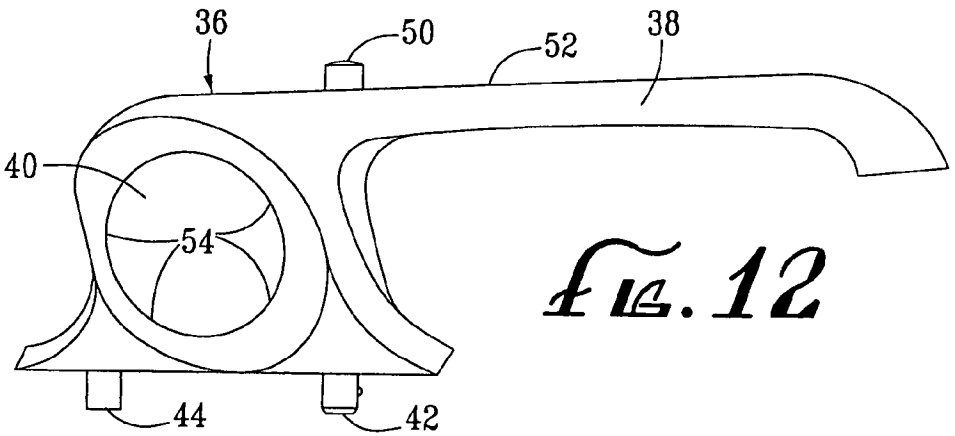
FIG. 12 is a side view of the grip guard illustrated in FIG. 9.
Figure 13:
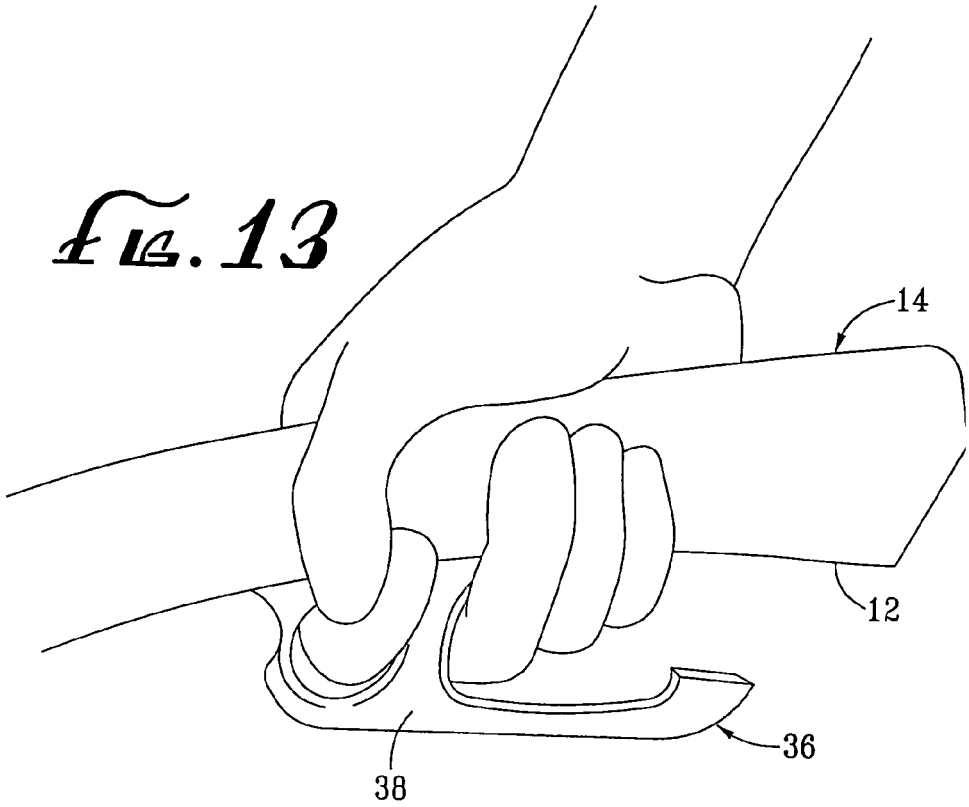
FIG. 13 is a side view of a handle carrying a grip guard having features of the invention.

In the embodiment illustrated in the drawings, the knuckle guard 18 includes a forward facing opening 34 which allows a hand tool 34 using the basket 16 to be readily inserted and removed from my safety scabbard invention 33 disclosed in my pending U.S. patent application Ser. No. 09/417,529, the entirety of which is incorporated herein by this reference. The forward facing opening 34 is adapted to surround the guide rail 35 of the safety scabbard 33 as illustrated in FIGS. 6–8.

In another embodiment, the invention is a "grip guard" 36 illustrated in FIGS. 9–14. Like the basket 16, the grip guard 36 comprises a knuckle guard 38 having one or more finger holes 40.

In the embodiment illustrated in the drawings, the grip guard 36 is attached to the base end 12 of the tool handle 14 using a single snap-on male connection pin 42 and one locator pin 44. Both pins 42 and 44 are adapted to be received within corresponding holes 46 disposed within the base end 12 of the hand tool handle 14. The hole 46 in the handle 14 which receives the male connection pin 42 comprises a corresponding female connector 48 adapted to rigidly retain the male connection pin 42 during use. The male connection pin 42 and the female connection pin 48 can be of the same types illustrated in FIG. 16. The embodiment of the grip guard 36 illustrated in the drawings is easily attached and deattached from the base end 12 of the hand tool handle 14 by depressing a spring loaded button 50 on the outside surface 52 of the grip guard 36 to release ball bearings (not shown) projecting laterally into the female connector 48.

Additional snap-on connection pins 42 can also be used in the securing of the grip guard 36 to the handle 14 of the hand tool 32.

In a preferred embodiment, the grip guard further comprises a lanyard receiving connection 53 suitable for attaching the grip guard to my lanyard invention fully described in my co-pending U.S. application Ser. No. 10/864,520, entitled "Hand Tool Lanyard System," which is incorporated herein in its entirety by this reference.

Like the basket 16, the grip guard 36 minimizes the chances that the user will inadvertently lose control of the tool 32. Also like the basket 16, the grip guard 36 markedly reduces fatigue to the hand muscles of the user by providing the user with additional gripping surfaces 54.

Figure 14:
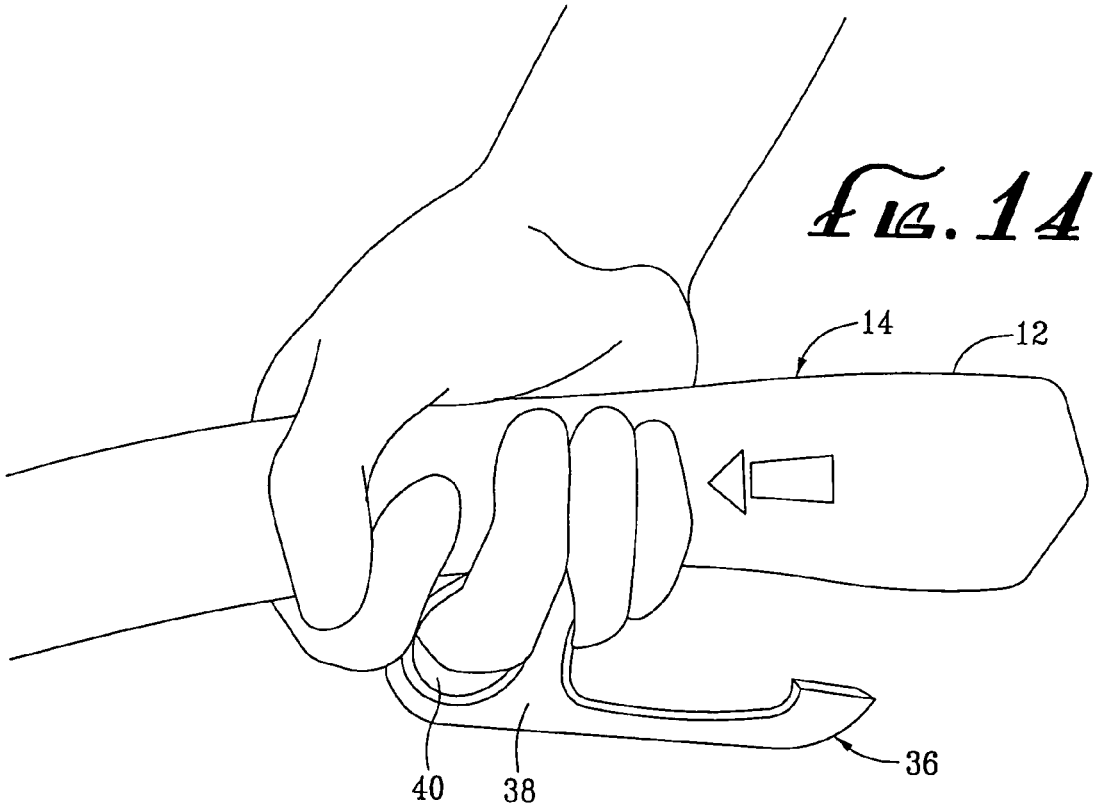
FIG. 14 illustrates the hand tool and grip guard combination illustrated in FIG. 13, wherein the combination is being gripped by the user in an alternative manner.

As illustrated in FIG. 14, the grip guard 36 also allows the user to conveniently "choke up" on the handle 14 of the tool 32 where required by the job to be accomplished.

In another embodiment, the invention is a thumb spur 56 as illustrated in FIGS. 15–18. The thumb spur 56 is a knob which is readily attachable and deattachable to the base end 12 of the hand tool handle 14. In a typical embodiment, the thumb spur 56 comprises an elastomeric body 58 with a quick release male connection pin 60 disposed down the center of the body 58. Typically, the body 58 is made from a soft rubber or synthetic rubber material. Like the snap-on connection pin 42 used in the grip guard 36, the quick release male connection pin 60 allows the snap-on connection of the thumb spur 56 to a corresponding female receptor 62 disposed within the base 12 of the hand tool. In an alternative embodiment, the body 58 of the thumb spur 56 may be attachable to the handle 14 of the hand tool 32 via a threaded screw connection or other connection means known to the art.

The body 58 of the thumb spur 56 is typically between about ¾ inches and about 1¼ inches in length and has a diameter of between about ½ inches and about ¾ inches. Preferably, the male connection pin 60 is freely rotatable within the female connector 62 to minimize blistering of the user's abutting thumb or fingers during use.

Figure 16:
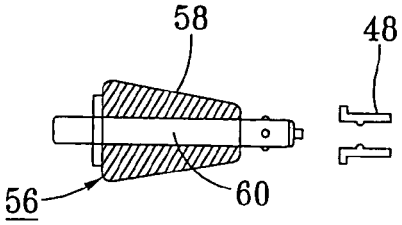
FIG. 16 is a cross-sectional side view of the thumb spur illustrated in FIG. 15.
Figure 15:
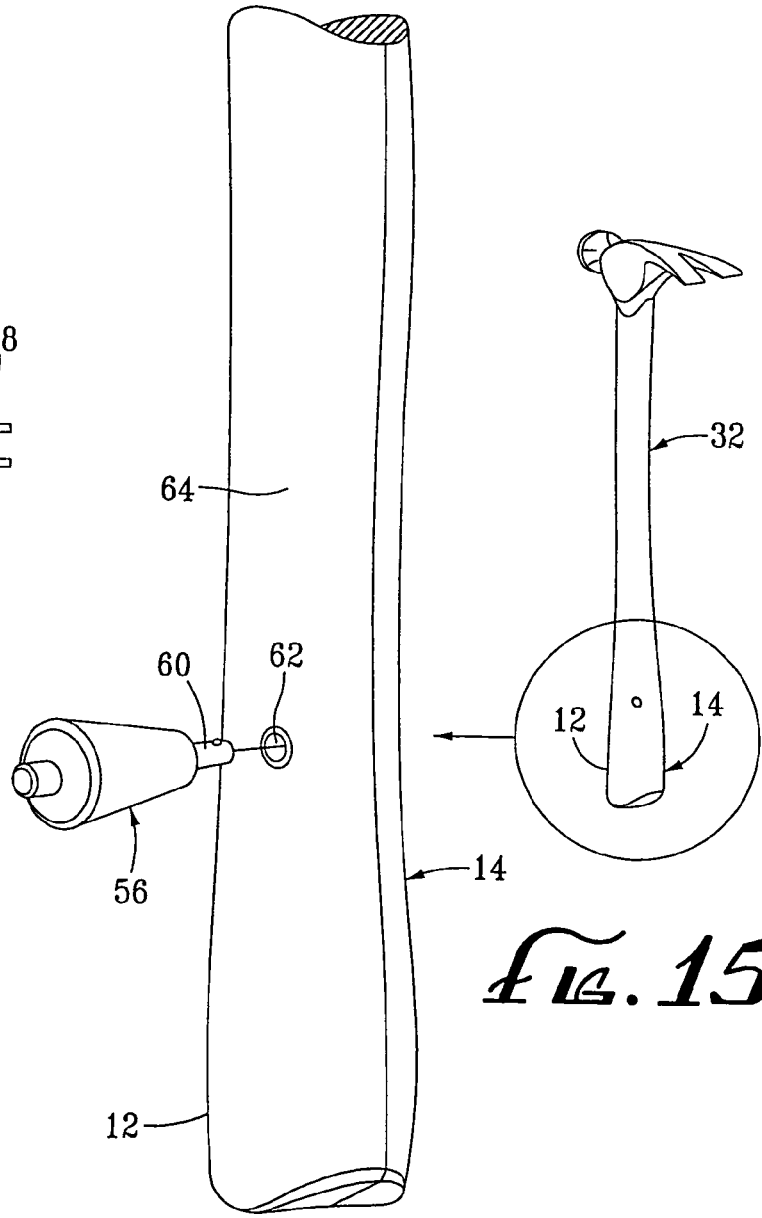
FIG. 15 is a isometric view of a hand tool and thumb spur combination having features of the invention.
Figure 17:
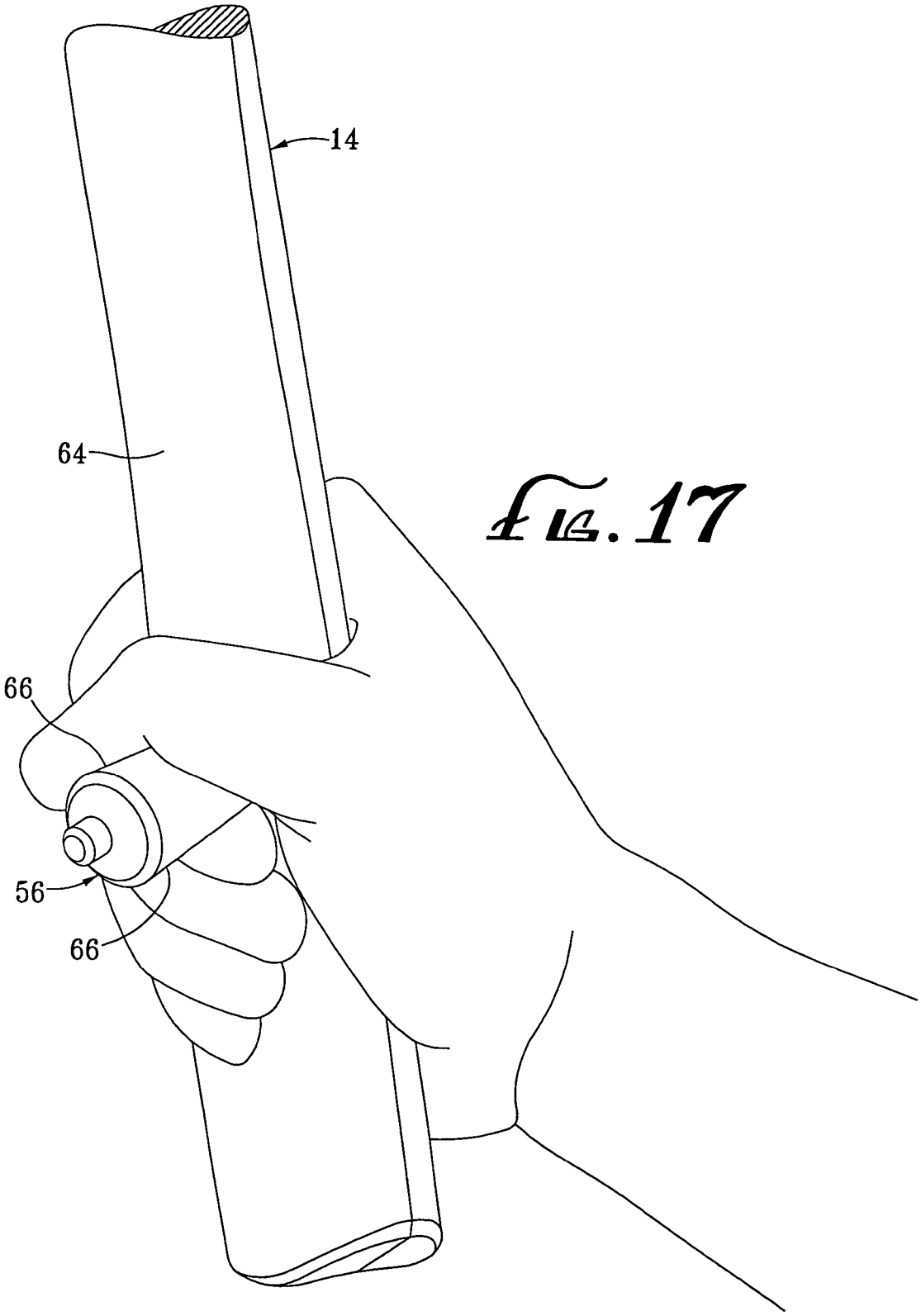
FIG. 17 is a isometric view of a handle and thumb spur combination having features of the invention.
Figure 18:
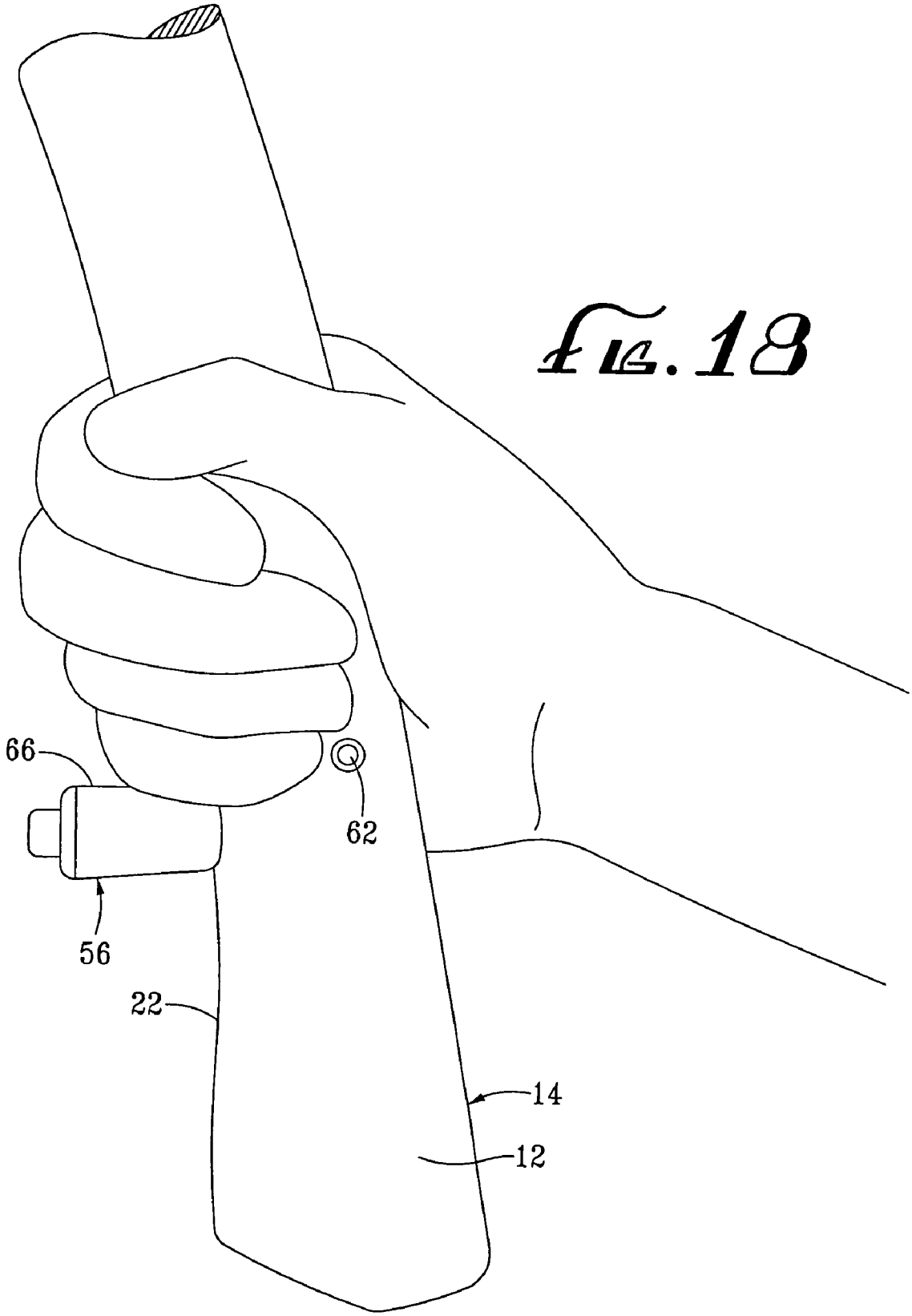
FIG. 18 is an isometric view of an alternative hand tool and thumb spur combination having features of the invention.

The thumb spur 56 can be effectively used when attached to the side 64 of the hand tool handle 14 as illustrated in FIGS. 16 and 17. Alternatively, the thumb spur 56 can be effectively used when attached to the underside 22 of the hand tool handle 14 as illustrated in FIG. 18. When attached to the side 64 of the handle 14, the thumb spur 56 provides the thumb and a finger of the user with additional gripping surfaces 66. When the thumb spur is used on the underside 22 of the hand tool handle 14, the thumb spur 56 provides the additional gripping surfaces 66 to the fingers of the user.

The thumb spur 56 has been found to provide additional gripping ability and control for a wide variety of elongate items. For example, the thumb spur can be used to increase gripping ability and support to baseball bats, tennis rackets, golf clubs, javelins, hockey sticks, pole vault poles, cricket bats, ski poles, hand gun stocks, rifle and shot gun stocks, archery bows, etc. Also, the thumb spur can be advantageously used on a variety of handled tools, such as rakes, picks, mattocks, hoes, long-reach trimmers, brooms, weed whackers, wheel barrows, chain saws, machetes, large knives, cleavers, tenderizers, pot and pan handles, etc. In fact, the thumb spur can be advantageously used with virtually any tool or other object having a handle. The handles of all such tools and objects are preferably manufactured with one or more female receptors 62 so that a thumb spur 56 can be conveniently used with the tool or objects whenever it would be advantageous to do so.

Figure 19:
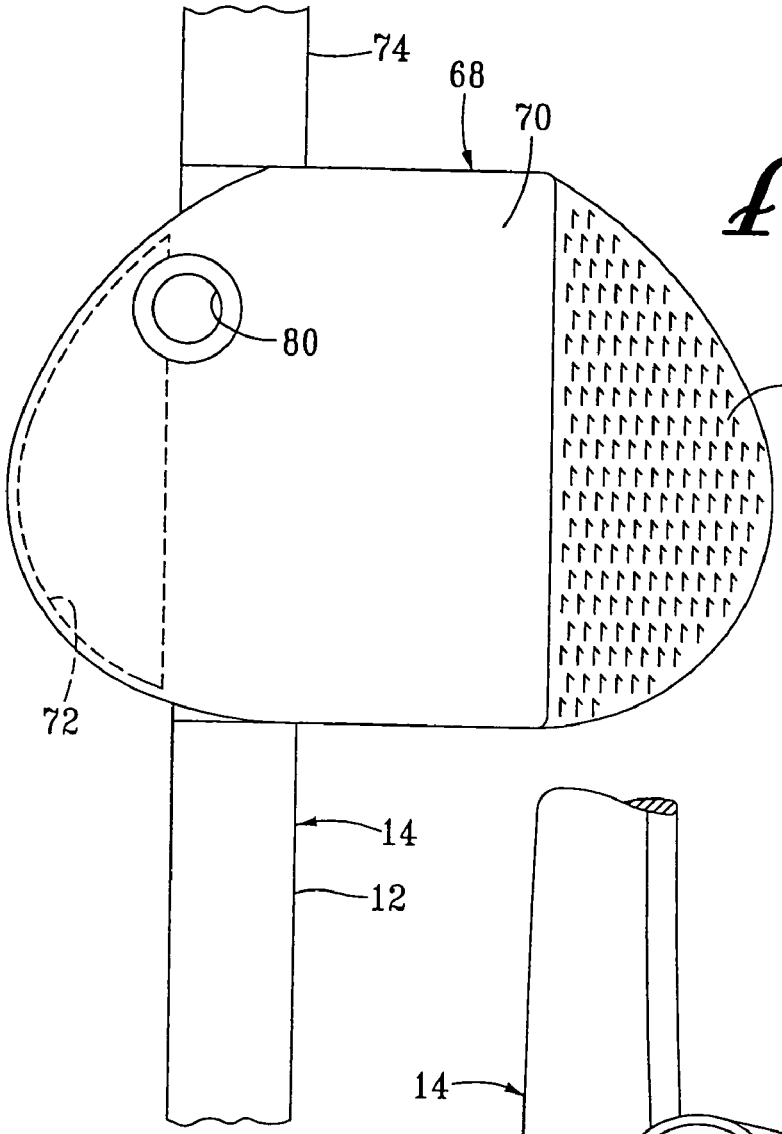
FIG. 19 is an isometric view of a hand tool, thumb spur and chrysalis combination having features of the invention, wherein the chrysalis is shown in a pre-wrapped position.
Figure 20:
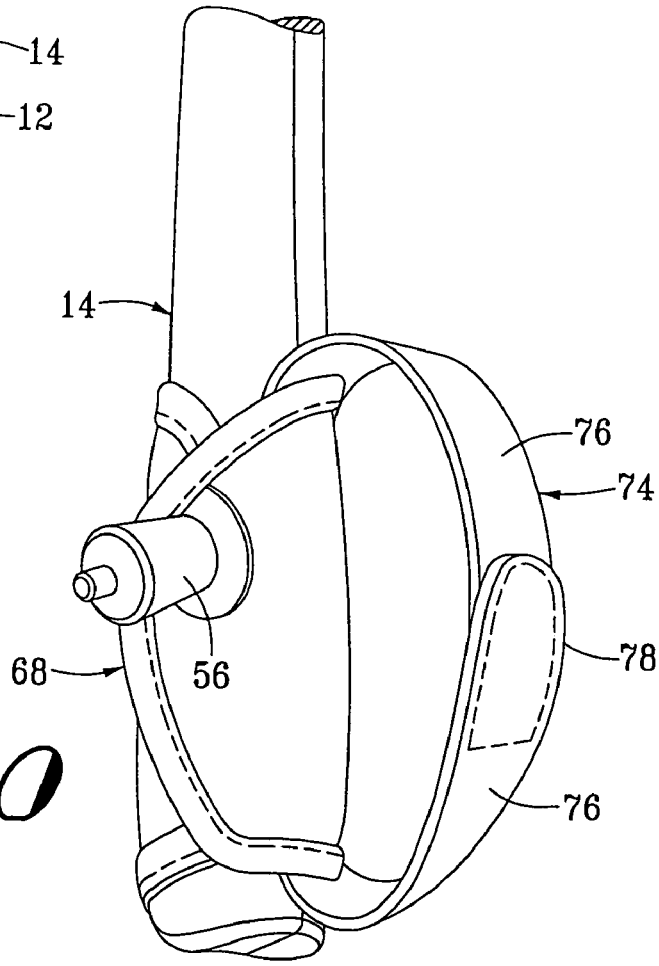
FIG. 20 is an isometric view of the combination of FIG. 19 showing the chrysalis attached to the handle.
Figure 21:
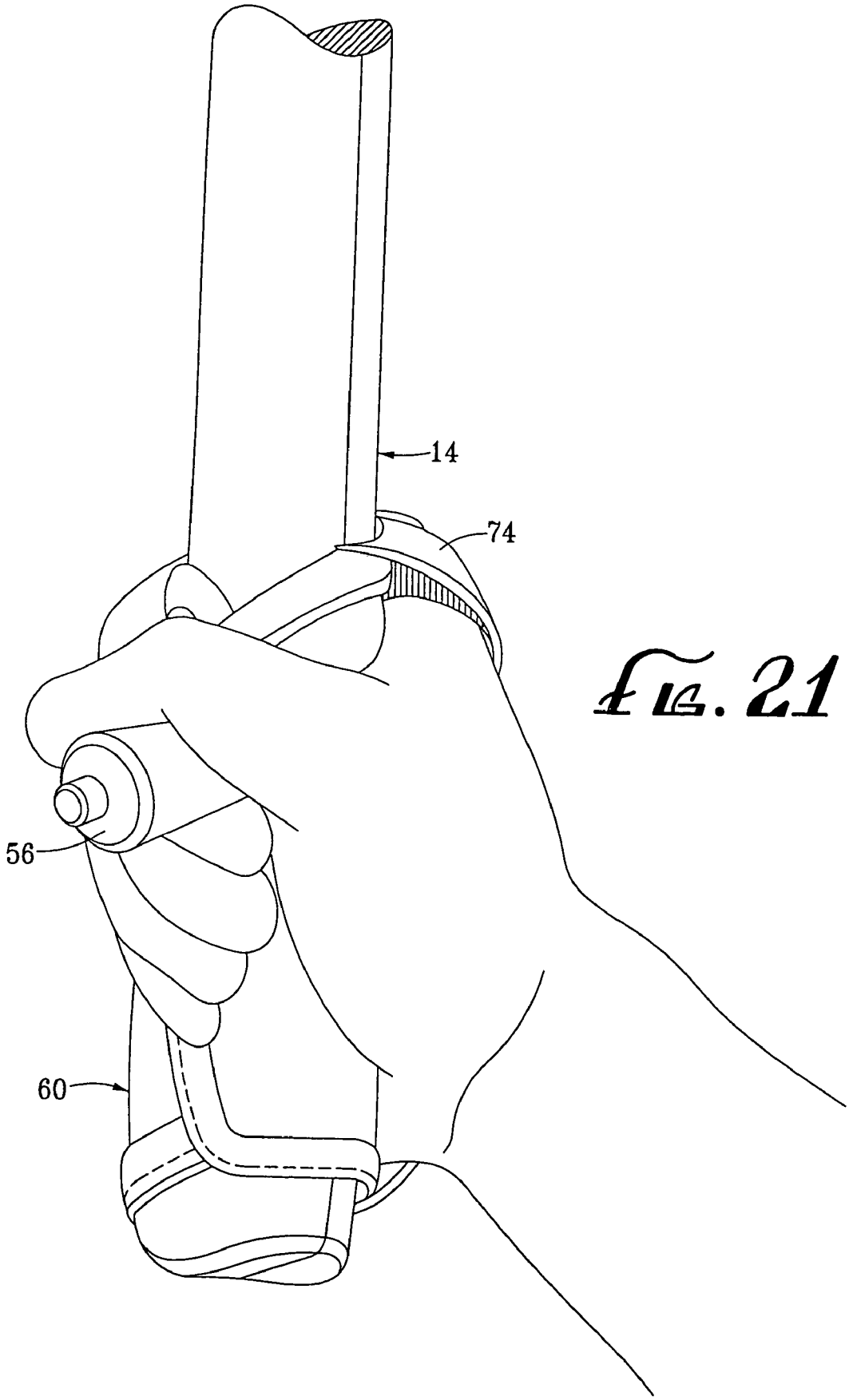
FIG. 21 is an isometric view of the combination illustrated in FIG. 20, showing the combination in use.

In another embodiment, the invention is a chrysalis 68. The chrysalis 68 comprises a sheet of flexible material 70 adapted to be wrapped around the base end 12 of the hand tool handle 14. The sheet of flexible material 70 is sufficiently large that the hand of a user grippinp the handle 14 touches only the chrysalis 68 and the thumb spur 56, as illustrated in FIGS. 19–21. Preferably, the flexible material is padded to provide comfort to the hand of the user during use. In the embodiment illustrated in the drawings, the chrysalis 68 is secured to the handle 14 using hook and loop fasteners 72.

Preferably, the chrysalis 68 further comprises a control strap 74 adapted to conform to the back side of the user's hand. Most preferably, the control strap 74 is made from two opposed strap members 76 which are attachable and readily adjustable by hook and loop fasteners 78.

In the embodiments illustrated in the drawings, the chrysalis 68 is further secured to the handle of the hand tool 32 using a thumb spur 56 disposed within a reenforced thumb spur opening 80.

The use of the chrysalis 68, especially in combination with a thumb spur 56, has been found to markedly increase control and comfort in the use of heavy pounding and chopping tools 32, such as hammers and hatchets.

Having thus described the invention, it should be apparent that numerous structural modifications and adaptations may be resorted to without departing from the scope and fair meaning of the instant invention as set forth hereinabove and as described hereinbelow by the claims.

What is claimed is:

1. A hand-held instrument comprising;

a business end;

a handle attached to the business end, the handle having a gripping portion and a longitudinal axis, a thumb spur being provided at the gripping portion of the handle, the thumb spur being disposed such that it projects away from the handle in a direction transverse to the longitudinal axis of the handle; and a chrysalis comprising a sheet of flexible material, the chrysalis being wrapped entirely around the gripping portion of the handle and being secured to the handle by the thumb spur, wherein the sheet of flexible material is sufficiently large such that the hand of a user gripping the handle of the instrument touches only the chrysalis and the thumb spur.

2. The handheld instrument of claim 1 wherein the sheet of flexible material is padded.

3. The handheld instrument of claim 1 wherein the thumb spur projects away from the handle by a distance of less than 4 inches.

4. The hand-held instrument of claim 1 wherein the thumb spur has a central portion which comprises an elastomeric material.

5. The hand-held instrument of claim 1 wherein the thumb spur is removably attached at the gripping portion of the handle.

6. The hand-held instrument of claim 1 wherein the thumb spur is removably attached to the gripping portion of the handle by a quick release attachment device.

7. The hand-held instrument of claim 6 wherein the quick release attachment device comprises a male connection pin and wherein the gripping portion of the handle is provided by at least one female receptor capable of accepting and firmly retaining the male connection pin.

8. The hand-held instrument of claim 7 wherein the gripping portion of the handle is generally oval in cross-section, having a pair of narrow end surfaces and a pair of wide opposed side surfaces, and wherein a female receptor is disposed in at least one of the wide side surfaces.

* * * * *